US005869921A

United States Patent [19]

Matsutani et al.

[11] Patent Number: 5,869,921

[45] Date of Patent: Feb. 9, 1999

[54] SPARK PLUG FOR INTERNAL COMBUSTION ENGINE HAVING PLATINUM AND IRIDIUM ALLOYED EMISSIVE TIPS

[75] Inventors: Wataru Matsutani; Tsutomu Okayama, both of Aichi, Japan

[73] Assignee: NGK Spark Plug Co., Ltd., Aichi, Japan

[21] Appl. No.: 848,681

[22] Filed: Apr. 29, 1997

[30] Foreign Application Priority Data

Apr. 30, 1996 [JP] Japan ..... 8-130549

[51] Int. Cl.[6] ..... H01J 13/20

[52] U.S. Cl. ..... 313/141; 313/141.1; 313/357

[58] Field of Search ..... 313/141, 141.1, 313/357

[56] References Cited

U.S. PATENT DOCUMENTS

| | | | |
|---|---|---|---|
| 1,850,819 | 3/1932 | Waltenberg et al. . | |
| 4,122,366 | 10/1978 | Von Stutterheim et al. | 313/141 |
| 4,324,588 | 4/1982 | Zysk et al. . | |
| 4,488,081 | 12/1984 | Kondo et al. . | |
| 4,581,558 | 4/1986 | Takamura et al. | 313/141 |
| 4,771,209 | 9/1988 | Ryan | 313/140 |

FOREIGN PATENT DOCUMENTS

| | | |
|---|---|---|
| 0 587 446 | 3/1994 | European Pat. Off. . |
| 58-59581 | 4/1983 | Japan . |
| 61-88479 | 5/1986 | Japan . |
| 63-257193 | 10/1988 | Japan . |
| 2-58756 | 12/1990 | Japan . |
| 479540 | 2/1938 | United Kingdom . |

OTHER PUBLICATIONS

Patent Abstracts of Japan, vol. 015, No. 423 (E–1127), Oct. 28, 1991 & JP 03 176979A (NGK Spark Plug Co Ltd), Jul. 31, 1991—Abstract.

*Primary Examiner*—Ashok Patel
*Assistant Examiner*—Matthew J. Gerike
*Attorney, Agent, or Firm*—Evenson, McKeown, Edwards & Lenahan P.L.L.C.

[57] ABSTRACT

In a spark plug for an internal combustion engine, a spark gap is defined between an insulated sparking portion and a grounded sparking portion. At least one of the insulated sparking portion and the grounded sparking portion is made of a molten alloy composed of (a) 99 to 80 wt. % of Ir and (b) 1 to 20 wt. % of Pt. The insulated sparking portion can be a center electrode or a discharge chip attached to a free end of the center electrode, while the grounded sparking portion can be a ground electrode or a discharge chip attached to a free end of the ground electrode.

3 Claims, 4 Drawing Sheets

SPARK PLUG FOR INTERNAL COMBUSTION ENGINE HAVING PLATINUM AND IRIDIUM ALLOYED EMISSIVE TIPS

BACKGROUND OF THE INVENTION a) Field of the Invention

This invention relates to a spark plug to be mounted on an internal combustion engine, especially to electrodes of the spark plug.

b) Description of the Related Art

As electrodes of a spark plug to be mounted on an internal combustion engine, those made of an alloy composed of 85 to 70 wt. % of Pt and 15 to 30 wt. % of Ir have been practically used to reduce the consumption (wear) of the electrodes through repetitions of a spark discharge to an air-fuel mixture in a combustion chamber of the internal combustion engine and hence to improve its durability [Japanese Patent Publication (Kokoku) No. HEI 2-58756]. With a view to achieving further improvements in the durability by minimizing the consumption of a center electrode through repetitions of a spark discharge, many electrodes made of Ir or sintered Ir—$Y_2O_3$ alloys have also been proposed and actually used.

During use in an ordinary internal combustion engine, the temperature of an insulator-supported center electrode, for example, at its central free end remains around about 800° C. When the electrode is made as in the conventional art, namely, is made of an alloy composed of 85 to 70 wt. % of Pt and 15 to 30 wt. % of Ir as disclosed in Japanese Patent Publication (Kokoku) No. HEI 2-58756 or is made of Ir or a sintered Ir—$Y_2O_3$ alloy, the consumption of the center electrode through repetitions of a spark discharge can be reduced because the alloy material making up the center electrode contains a great deal of Ir which has excellent spark consumption resistance in the temperature range of the central free end of the center electrode. Keeping in step with the recent move toward a higher power output in internal combustion engines, more heat may however be produced as a result of combustion of an air-fuel mixture in a combustion chamber of an internal combustion engine. The temperature of the center electrode at the central free end thereof exposed in the combustion chamber therefore rises considerably. When the temperature becomes as high as about 850° C. or higher, the volatility of $IrO_3$ which is formed on the center electrode as a result of repetitions of a spark discharge becomes significantly higher than that of $PtO_2$ formed likewise on the center electrode. In the high temperature range that the temperature of the center electrode is 850° C. and higher at the central free end thereof, vaporization of $IrO_3$ is more dominant than that of Pt or an alloy composed of 80 wt. % of Pt and 20 wt. % of Ir so that the spark consumption resistance of the center electrode is conversely reduced and the durability of the center electrode is also lowered.

To cope with the above-mentioned problem, it has also been proposed to sinter Ir powder or Ir—Pt mixed powder and to use the sintered product as a discharge electrode of a center electrode [Japanese Patent Applications Laid-Open (Kokai) Nos. SHO 61-88479 and SHO 63-257193, etc.]. In a discharge electrode formed by sintering as described above, Ir and Pt are however not alloyed in a uniformly distributed form as illustrated in FIG. 4. As a result, Ir-only portions and Pt-only portions are localized in the discharge electrode. In the high temperature range of 850° C. and higher at the central free end of the center electrode, more dominant vaporization of $IrO_3$ formed through repetitions of a spark discharge takes place compared with vaporization of $PtO_2$ formed from Pt or a Pt alloy. This results in nonuniform consumption of the electrode by sparks, leaving only porous Pt behind. There is accordingly a problem that the durability required for electrodes or the like cannot be sufficiently assured.

SUMMARY OF THE INVENTION

An object of the present invention is therefore to improve the above-described problems of the conventional electrodes, more specifically to improve the spark consumption resistance of electrodes through repetitions of a spark discharge therebetween by a simple but ingenious approach so that a spark plug improved fully in durability can be provided for use in an internal combustion engine.

In one aspect of the present invention, there is thus provided a spark plug for an internal combustion engine. At least one of an insulated sparking portion and a grounded sparking portion, which define a spark gap therebetween, is made of a molten alloy composed of (a) 99 to 80 wt. % of Ir and (b) 1 to 20 wt. % of Pt.

The insulated sparking portion and the grounded sparking portion may be a center electrode and a ground electrode, respectively. As an alternative, the insulated sparking portion and the grounded sparking portion may be a discharge chip attached to a free end of a center electrode and a discharge chip attached to a free end of a ground electrode, respectively.

Owing to the above-described features, the spark plug according to the present invention has excellent advantages. The spark consumption takes place evenly and moreover, slowly through repetitions of a spark discharge to an air-fuel mixture. The spark consumption of the insulated sparking portion and/or the grounded sparking portion can therefore be surely reduced, thereby assuring ignition of the air-fuel mixture. Further, this reduction in the spark consumption can significantly improve the durability of the spark plug itself.

DETAILED DESCRIPTION OF THE INVENTION AND PREFERRED EMBODIMENTS

Upon practicing the present invention, at least one of the insulated and grounded sparking portions defining the spark gap therebetween, for example, the center and ground electrodes or the discharge chips attached to the free ends of the center and ground electrodes are formed by a molten alloy composed of (a) 99 to 80 wt. % of Ir and (b) 1 to 20 wt. % of Pt. Different from a sintered alloy of Ir and Pt, Ir and Pt are alloyed in an evenly distributed form without localization of Ir or Pt in the electrodes or discharge chips made of the molten alloy. The term "molten" is therefore used herein to distinguish an alloy usable in the present invention from such a sintered alloy. Oxidation of Ir atoms in the electrodes or discharge chips caused through repetitions of a spark discharge to an air-fuel mixture in a combustion chamber of an internal combustion engine and spark consumption of the electrodes or discharge chips due to evaporation of the oxide in a high-temperature range therefore take place more evenly compared with conventional electrodes or discharge chips, so that uneven spark consumption which results in an advanced loss of Ir atoms can be reduced. It is therefore also possible to improve the durability of the spark plug itself.

Figure 1:
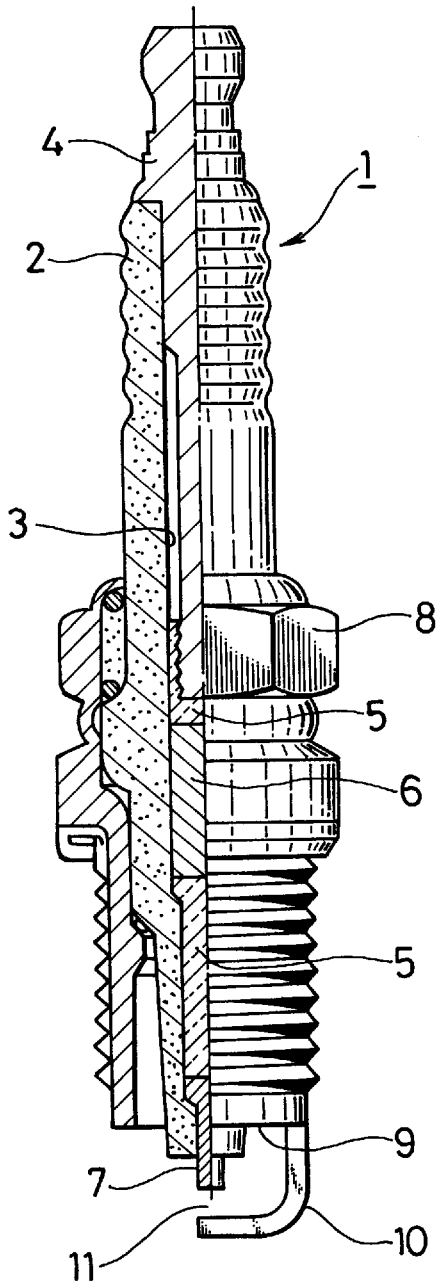
FIG. 1 is a partial cross-sectional view of a spark plug according to a first embodiment of the present invention for an internal combustion engine.

The spark plug according to the first embodiment of the present invention for the internal combustion engine will hereinafter be described with reference to FIG. 1. Designated at numeral 1 is the spark plug according to the first embodiment of the present invention for the internal combustion engine. The spark plug 1 is constructed of an insulator 2, a ground electrode 10 and a metal shell 8. The insulator 2 has an axial bore 3, in which a resistor 6 is sealed and held in place between electrically-conductive glass seals 5,5. A terminal electrode 4 and a flanged center electrode 7 extend out in opposite directions from the axial bore 3 and are fixedly held at inner parts thereof in the axial bore 3 by the corresponding glass seals 5,5. The metal shell 8 fixedly holds therein the insulator 2. A spark gap 11 is defined between the center electrode 7 and the ground electrode 10 arranged extending from a ring-shaped end surface 9 of the metal shell 8.

In the spark plug 1 according to the first embodiment of the present invention, the center electrode 7 is made of a molten alloy which is composed of 99 to 80 wt. % of Ir and 1 to 20 wt. % of Pt.

In the center electrode 7, Ir and Pt are alloyed in an evenly distributed form without localization of Ir or Pt. Oxidation of Ir atoms in the center electrode 7 through repetitions of a spark discharge to an air-fuel mixture in a combustion chamber of an internal combustion engine and spark consumption of the center electrode 7 due to evaporation of the oxide in a high-temperature range therefore take place more evenly compared with conventional center electrodes, so that uneven spark consumption which results in an advanced loss of Ir atoms can be reduced. It is therefore also possible to improve the durability of the spark plug 1 itself. Needless to say, the molten Ir—Pt alloy which makes up the center electrode 7 can also be used for the ground electrode 10. Incidentally, the center electrode 7 can be fixedly held in the insulator 2 by inserting it in an unsintered green insulator 2 and then sintering the green insulator 2 together with center electrode 7.

Figure 2:
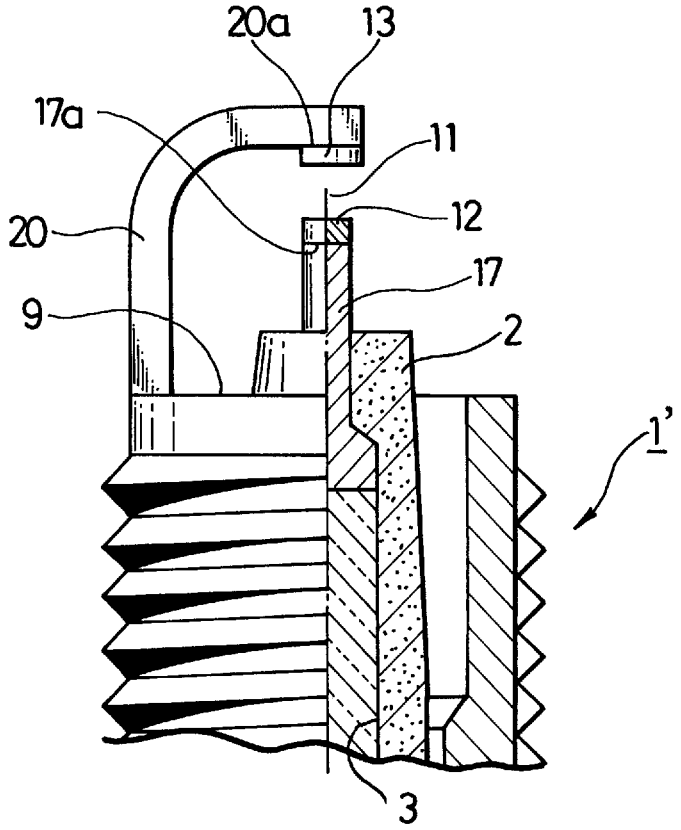
FIG. 2 is an enlarged, fragmentary, cross-sectional view of a spark plug according to a second embodiment of the present invention for an internal combustion engine.

Referring next to FIG. 2, the spark plug 1' according to the second embodiment of the present invention for the internal combustion engine will be described. In the spark plug 1', a center electrode 17 is fixedly held in an axial bore 3 of an insulator 2. This center electrode 17 is composed of a composite electrode material which is made of a Ni alloy as a covering layer and Cu, a Cu alloy or the like sealed inside the covering layer. The center electrode 17 terminates in a free end surface 17*a* of a smaller diameter. A discharge chip 12 formed of a molten alloy, which is composed of 99 to 80 wt. % of Ir and 1 to 20 wt. % of Pt, has been joined to the free end surface 17*a*.

When ignition to an air-fuel mixture is conducted at a spark gap 11 as in the above-described first embodiment of the present invention, oxidation of Ir atoms in the discharge chip 12 through repetitions of a spark discharge to the air-fuel mixture and spark consumption of the discharge chip 12 due to evaporation of the oxide in a high-temperature range therefore take place more evenly compared with conventional discharge chips owing to the formation of the discharge chip 12 with the molten alloy composed of 99 to 80 wt. % of Ir and 1 to 20 wt. % of Pt. Uneven spark consumption that only $IrO_3$, an oxide of Ir, evaporates in advance is therefore reduced, whereby the durability of the spark plug 1' itself can be improved.

The molten Ir—Pt alloy can also be used for a discharge chip 13 joined to a free end surface 20*a* of a ground electrode 20 and located opposite the discharge chip 12. Further, the molten Ir—Pt alloy can also be used as an electrode material for both the center electrode 17 and the ground electrode 20.

Figure 3:
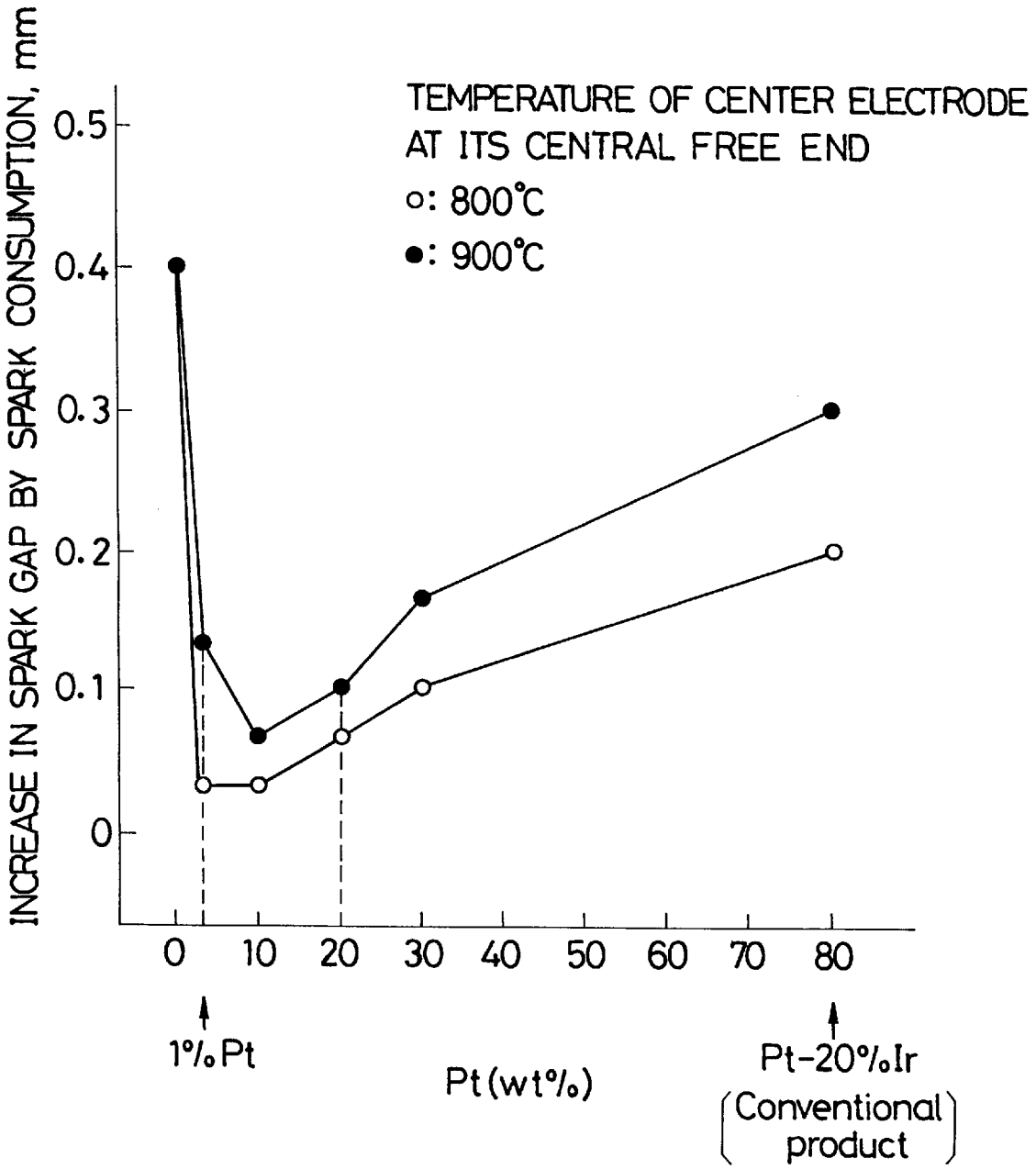
FIG. 3 diagrammatically shows the results of a measurement of increases (mm) in spark gap by spark consumption (i.e., wearing of electrodes through repetitions of a spark discharge) as a function of the content (wt. %) of Pt in full-power durability tests (400 hours; equivalent to about 60,000 km driven distance) in which the temperatures of center electrodes at their central free ends were set at 800° C. and 900° C., respectively.
Figure 4:
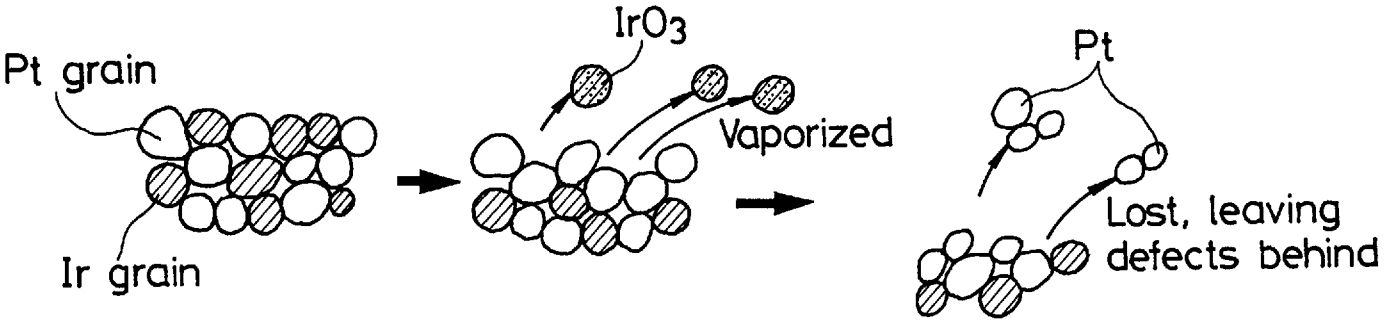
FIG. 4 PRIOR ART
FIG. 4 illustrates the mechanism of a spark consumption in a conventional sintered alloy of Pt—Ir powder.

To ascertain the advantageous effects of the present invention, spark plugs of the same type as the spark plug 1' according to the second embodiment of the present invention were produced by setting the diameter of the discharge chip 12 of the center electrode 17 at 0.7 mm. Increases (mm) in spark gap by spark consumption were measured as a function of the content (wt. %) of Pt by mounting those spark plugs on a 4-cylinder 2000-cc internal combustion engine and then conducting full-power durability tests (400 hours; equivalent to about 60,000 km driven distance) in which the temperatures of center electrodes at their central free ends were set at 800° C. and 900°C., respectively. As a result, it was found that, as is illustrated in FIG. 3, the increase in spark gap by spark consumption can be reduced at Pt contents of from 1 to 30 wt. %, notably in a Pt content range of from 1 to 20 wt. %. The advantageous effects of the present invention were therefore clearly confirmed.

In each of the embodiments of the present invention, the center electrode or the discharge chip joined to the free end surface of the center electrode was made of the molten alloy composed of 99 to 80 wt. % of Ir and 1 to 20 wt. % of Pt. The upper limit of the Pt content (wt. %) has been set at 20 wt. %, because no substantial additional merit can be expected from a Pt content (wt. %) higher than 20 wt. % when the effects of such a high Pt content in reducing the spark consumption of the center electrode or the discharge chip and the production cost of a spark plug with a center electrode or discharge chip made of such a high-Pt molten alloy are taken into parallel consideration.

What is claimed is:

1. A spark plug for an internal combustion engine, wherein at least one of an insulated sparking portion and a grounded sparking portion, which define a spark gap therebetween, is made of a molten alloy comprising (a) 99 to 80 wt. % of Ir and (b) 1 to 20 wt. % of Pt.

2. The spark plug of claim 1, wherein said insulated sparking portion and said grounded sparking portion are a center electrode and a ground electrode, respectively.

3. The spark plug of claim 1, wherein said insulated sparking portion and said grounded sparking portion are a discharge chip attached to a free end of a center electrode and a discharge chip attached to a free end of a ground electrode, respectively.

* * * * *